US006017479A

United States Patent [19]

Helms, Jr. et al.

[11] Patent Number: 6,017,479

[45] Date of Patent: Jan. 25, 2000

[54] PROCESS OF MAKING A MULTIPLE DOMAIN FIBER HAVING AN INTER-DOMAIN BOUNDARY COMPATIBILIZING LAYER

[75] Inventors: Charles F. Helms, Jr., Asheville; Diane R. Kent; Matthew B. Hoyt, both of Arden; James R. Bristow; Phillip E. Wilson, both of Asheville, all of N.C.

[73] Assignee: BASF Corporation, Mt. Olive, N.J.

[21] Appl. No.: 09/196,576

[22] Filed: Nov. 20, 1998

Related U.S. Application Data

[62] Division of application No. 09/004,676, Jan. 8, 1998, Pat. No. 5,879,801

[60] Provisional application No. 60/034,744, Jan. 10, 1997.

[51] Int. Cl.[7] ..... D01D 5/12; D01D 5/32; D01D 5/34; D01F 8/06; D01F 8/12

[52] U.S. Cl. ..... 264/172.12; 264/172.14; 264/172.15; 264/172.18; 264/210.8

[58] Field of Search ..... 264/172.12, 172.14, 264/172.15, 172.18, 177.13, 210.8

[56] References Cited

U.S. PATENT DOCUMENTS

| | | | |
|---|---|---|---|
| 3,718,534 | 2/1973 | Okamoto et al. | 428/374 |
| 4,069,363 | 1/1978 | Segraves et al. | 442/311 |
| 4,370,114 | 1/1983 | Okamoto et al. | 425/131.5 |
| 4,439,487 | 3/1984 | Jennings | 428/397 |
| 4,732,809 | 3/1988 | Harris et al. | 428/373 |
| 5,125,818 | 6/1992 | Yeh | 425/131.5 |
| 5,162,074 | 11/1992 | Hills | 216/83 |
| 5,166,278 | 11/1992 | Rao | 525/432 |
| 5,344,297 | 9/1994 | Hills | 425/370 |
| 5,445,884 | 8/1995 | Hoyt et al. | 428/370 |
| 5,533,883 | 7/1996 | Hodan et al. | 425/131.5 |
| 5,582,913 | 12/1996 | Simons | 428/373 |

*Primary Examiner*—Leo B. Tentoni

[57] ABSTRACT

Multicomponent fibers and methods and apparatus for producing the same are provided such that an inter-domain boundary layer is interposed between distinct domains formed of incompatible polymers so as to minimize (if not eliminate entirely) separation of the domains at their interfacial boundary. The inter-domain boundary layer is formed of a heterogeneous mixture of the polymers forming the respective adjacent domains between which the boundary layer is interposed. The inter-boundary layer will most preferably include rivulets or fingers of each polymer forming the adjacent domains which interlock with one another in a randomly tortuous manner. These different polymer rivulets thereby effectively increase the surface area and mechanical interlocking at the interfacial boundary between the fiber domains thereby increasing the adhesion therebetween.

8 Claims, 7 Drawing Sheets

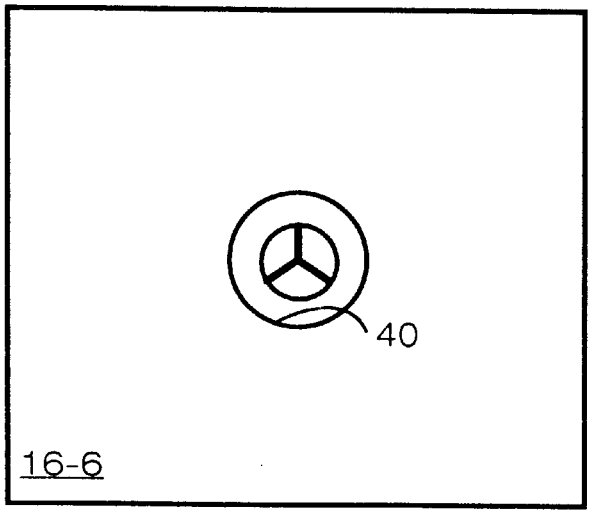
Fig. 9
Fig. 1
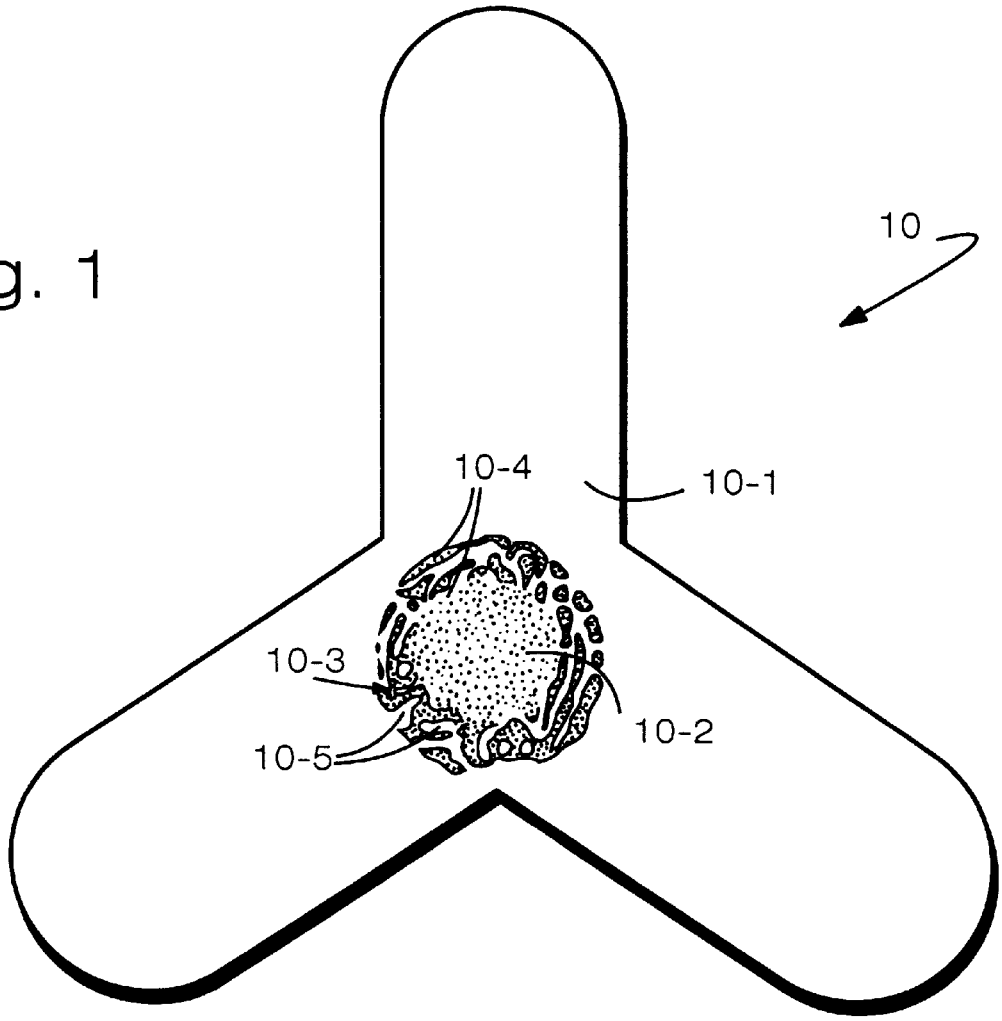

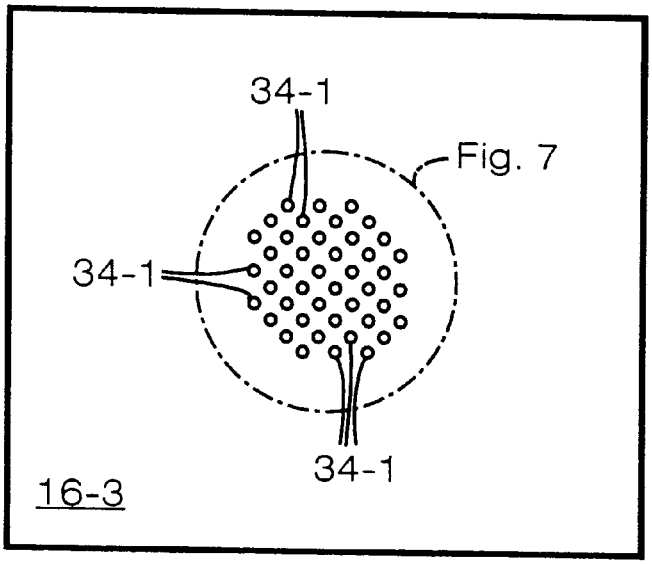
Fig. 5
Fig. 6
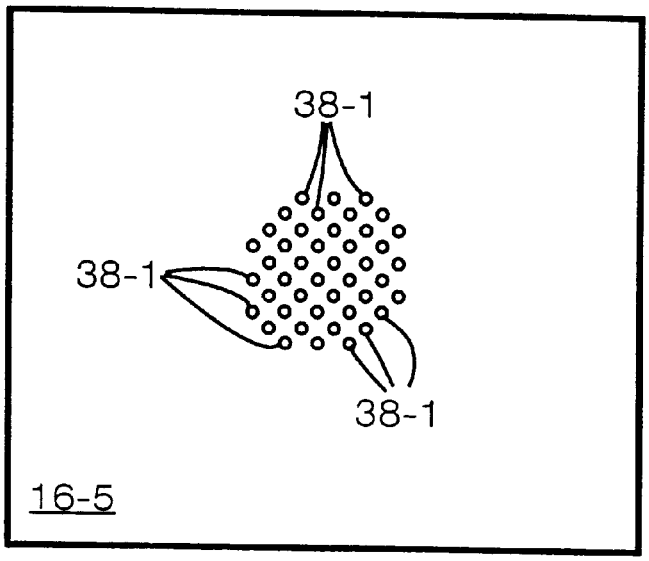

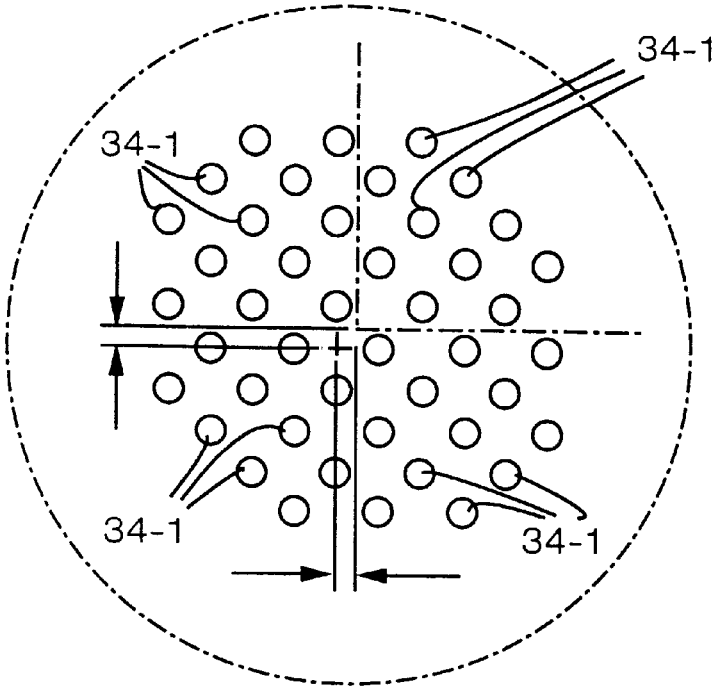
Fig. 7
Fig. 8
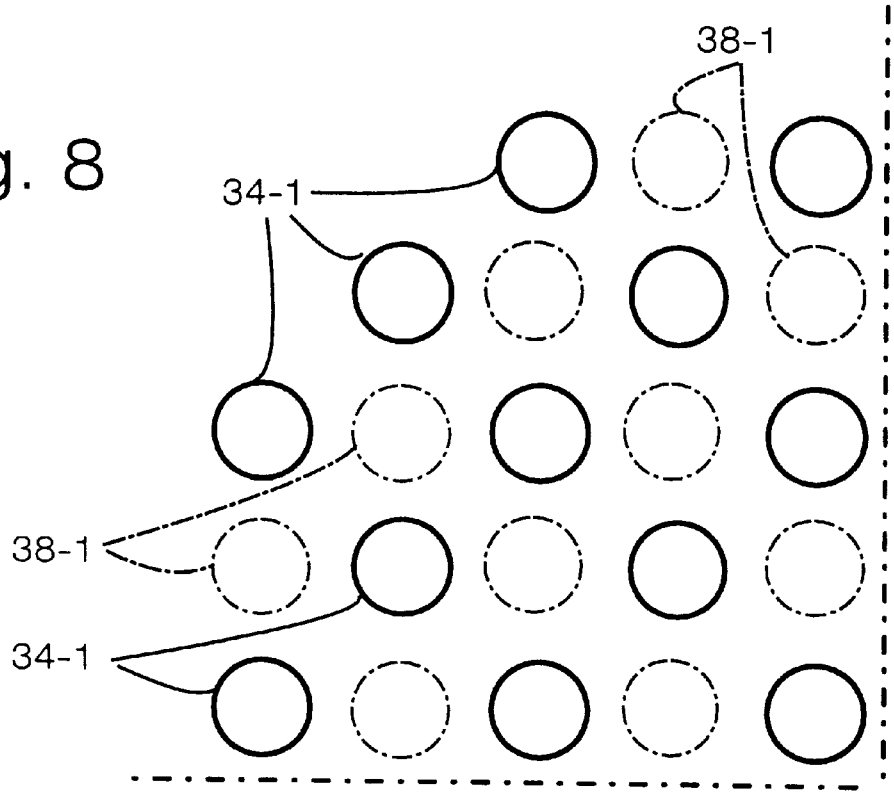

Condition 1.0L

Condition 1.1L

Condition 1.2L

Condition 1.0R

Condition 1.1R

Condition 1.2R

PROCESS OF MAKING A MULTIPLE DOMAIN FIBER HAVING AN INTER-DOMAIN BOUNDARY COMPATIBILIZING LAYER

CROSS-REFERENCE TO RELATED APPLICATIONS

This application is a divisional of application Ser. No. 09/004,676, filed Jan. 8, 1998, now U.S. Pat. No. 5,879,801. This application claims priority of U.S. Provisional Application Ser. No. 60/034,744, filed Jan. 10, 1997.

This application may be deemed to be related to commonly owned copending U.S. Provisional Patent Application Ser. No. 60/034,748, filed even date herewith in the names of Diane R. Kent et al. entitled "Multiple Domain Fibers Having Inter-Domain Boundary Compatibilizing Layer and Methods of Making the Same" (Attorney Docket No. 1005-93), the entire content of which is expressly incorporated hereinto by reference.

FIELD OF INVENTION

The present invention relates generally to synthetic fibers and the techniques by which such synthetic fibers are made. More particularly, the present invention relates to synthetic fibers having multiple distinct polymer domains formed of different polymers which may inherently be incompatible with one another, and an inter-domain compatibilizing boundary layer between the distinct domains.

BACKGROUND AND SUMMARY OF THE INVENTION

Multicomponent fibers are, in and of themselves, well known and have been used extensively to achieve various fiber properties. For example, multicomponent fibers have been formed of two dissimilar polymers so as to impart self-crimping properties. See U.S. Pat. No. 3,718,534 to Okamoto et al. and U.S. Pat. No. 4,439,487 to Jennings. Multicomponent fibers of two materials having disparate melting points for forming point bonded nonwovens are known, for example, from U.S. Pat. No. 4,732,809 to Harris et al. Asymmetric nylon-nylon sheath-core multicomponent fibers are known from U.S. Pat. No. 4,069,363 to Seagraves et al.

One problem that is encountered when multicomponent fibers are formed having distinct domains of dissimilar polymers which are incompatible with one another is that the domains often separate at the boundary between the domains. This separation results in fracturing or splitting of the fiber thereby weakening the system (e.g., yarn, fabric, carpet or like textile product) in which the fiber is used. Weakening of the fiber system can be sufficiently acute to prevent the system from undergoing downstream processing (e.g., drawing, texturing, heat-setting, tufting, knitting, weaving and the like). Furthermore, such fracturing and/or splitting of the fibers can result in poor product qualities such as poor appearance and poor wear performance.

It would therefore be highly desirable if multicomponent fibers having distinct longitudinally coextensive polymer domains formed of different polymers could be produced which have minimal (if any) inter-domain fracturing and/or splitting. It is towards providing such a fiber and method of producing the same that the present invention is directed.

Broadly, the present invention is directed to a multicomponent fiber and methods and apparatus of producing the same whereby an inter-domain boundary layer is interposed between distinct domains formed of different polymers so as to minimize (if not eliminate entirely) separation of the domains at their interfacial boundary. The inter-domain boundary layer therefore is provided so as to provide an interlocking region between the fiber domains and thereby impart greater structural integrity to the fiber.

In preferred embodiments, the inter-boundary layer is formed of a heterogeneous mixture of the polymers forming the respective distinct fiber domains. That is, the interboundary layer will include rivulets or fingers of each polymer forming the adjacent domains which interlock with one another in a randomly tortuous manner. These different polymer rivulets thereby effectively increase the surface area at the interfacial boundary between the fiber domains thereby increasing the adhesion therebetween. In addition, a certain degree of mechanical interlocking is believed to occur by virtue of the randomly tortuous manner in which such rivulets are physically disposed in the inter-domain layer.

These and other aspects and advantages of the present invention will become more clear after careful consideration is given to the detailed description of the preferred exemplary embodiments thereof which follow.

BRIEF DESCRIPTION OF THE DRAWINGS

Reference will hereinafter be made to the accompanying drawings wherein like reference numerals throughout the various FIGURES denote like structural elements, and wherein;

FIG. 1 is an enlarged diagrammatic cross-sectional view of one preferred symmetric bicomponent trilobal fiber in accordance with the present invention;

FIG. 5 depicts a compatibilizer plate that may be employed in the spinnerette of the system depicted in FIG. 2;

FIG. 6 depicts another compatibilizer plate that is preferably positioned downstream of the plate depicted in FIG. 5;

FIG. 7 is an enlarged plan view depicting the aperture pattern preferably employed in the compatibilizer plate of FIG. 5;

FIG. 8 is an enlarged region of the aperture pattern shown in FIG. 7 which also depicts the aperture misregistration as between the plates shown in FIGS. 5 and 6, respectively;

FIG. 9 diagrammatically depicts a top plan view of a spinnerette plate that may be employed to melt-spin the fiber cross-section depicted in FIG. 1.

DETAILED DESCRIPTION OF THE PREFERRED EXEMPLARY EMBODIMENTS

Figure 2:
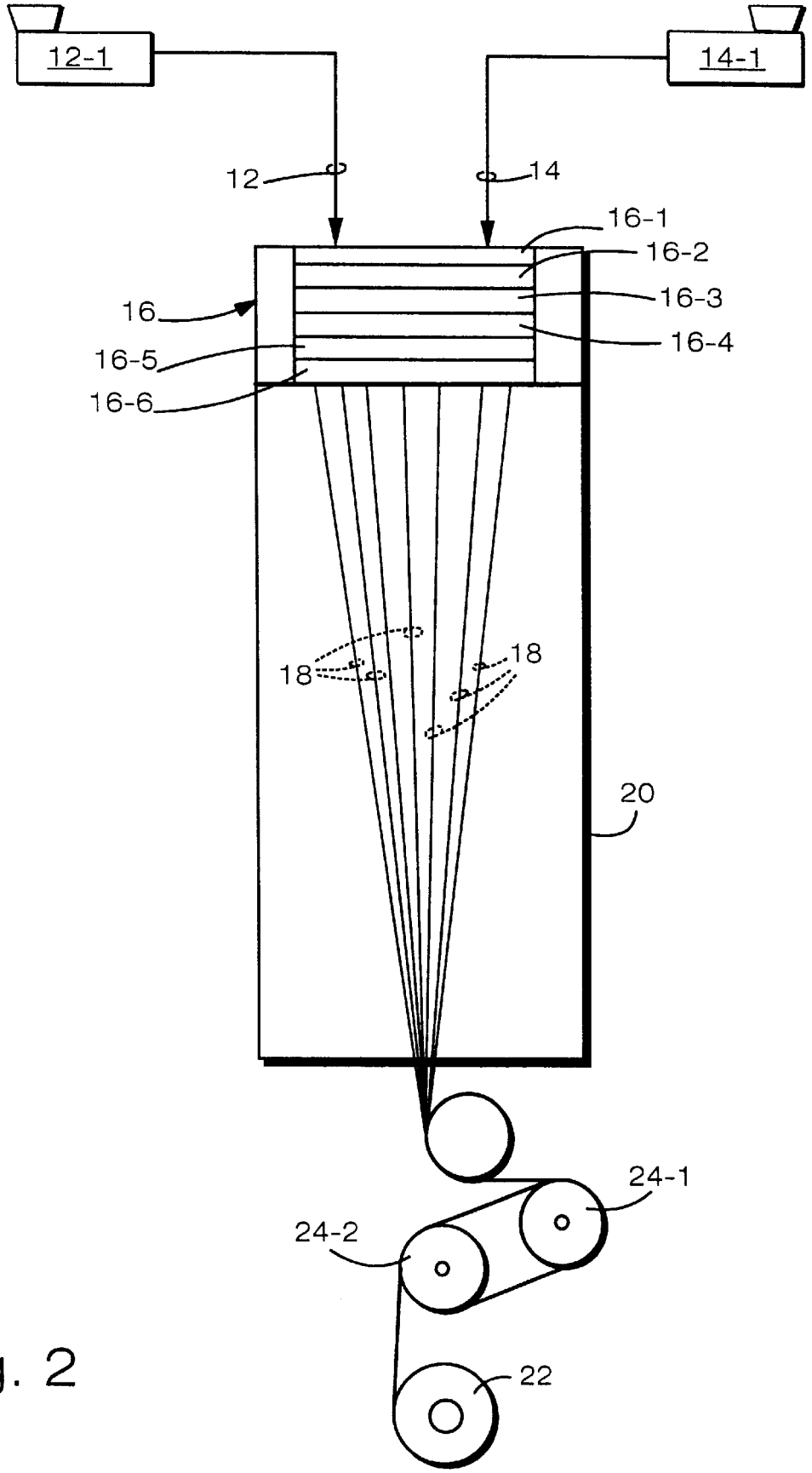
FIG. 2 is a diagrammatic elevational view showing a melt-spinning system that may be employed to form the fiber depicted in FIG. 1.
Figure 3A:
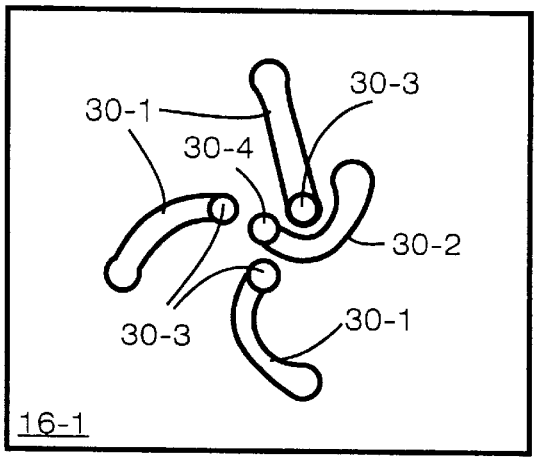
FIGS. 3A and 3B diagrammatically depict the top and bottom plan views, respectively of a distribution plate that may be employed in the spinnerette of the system depicted in FIG. 2.
Figure 3B:
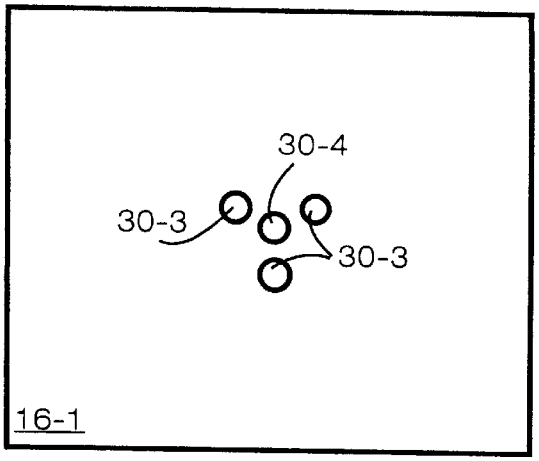

As used herein and in the accompanying claims, the term "fiber-forming" is meant to refer to at least partly oriented, partly crystalline, linear polymers which are capable of being formed into a fiber structure having a length at least 100 times its width and capable of being drawn without breakage at least about 10%.

The term "non-fiber-forming" is therefore meant to refer to amorphous (non-crystalline) linear polymers which may be formed into a fiber structure, but which are incapable of being drawn without breakage at least about 10%.

The term "fiber" includes fibers of extreme or indefinite length (filaments) and fibers of short length (staple). The term "yarn" refers to a continuous strand or bundle of fibers.

The term "multicomponent fiber" is a fiber having at least two distinct cross-sectional longitudinally coextensive domains respectively formed of different polymers. The distinct domains may thus be formed of polymers from different polymer classes (e.g., nylon and polypropylene) or be formed of polymers from the same polymer class (e.g., nylon) but which differ in their respective relative viscosities.

The term "multicomponent fiber" is thus intended to include concentric and eccentric sheath-core fiber structures, symmetric and asymmetric side-by-side fiber structures, island-in-sea fiber structures and pie wedge fiber structures.

The term "incompatible polymers" and like terms are meant to refer to polymers which cannot be melt-blended with one another. Thus, when incompatible polymers are melt-spun to form a multicomponent fiber having distinct cross-sectional domains formed from each respective incompatible polymer, there will be substantially no inter-domain adhesion at the boundary layer(s) therebetween.

Virtually any fiber-forming polymer may usefully be employed in the practice of this invention. In this regard, suitable classes of polymeric materials that may be employed in the practice of this invention include polyamides, polyesters, acrylics, polyolefins, maleic anhydride grafted polyolefins, and acrylonitriles. More specifically, nylon, low density polyethylene, high density polyethylene, linear low density polyethylene and polyethylene terephthalate may be employed. Each distinct domain forming the bicomponent fibers of this invention may be formed from different incompatible polymeric materials. Alternatively, some of the domains may be formed from incompatible polymers while other domains may be formed from polymers which are compatible with the polymer forming an adjacent domain.

One particularly preferred class of polymers used in forming the bicomponent fibers of this invention is polyamide polymers. In this regard, those preferred polyamides useful to form the bicomponent fibers of this invention are those which are generically known by the term "nylon" and are long chain synthetic polymers containing amide (—CO—NH—) linkages along the main polymer chain. Suitable melt spinnable, fiber-forming polyamides for the sheath of the sheath-core bicomponent fibers according to this invention include those which are obtained by the polymerization of a lactam or an amino add, or those polymers formed by the condensation of a diamine and a dicarboxylic acid. Typical polyamides useful in the present invention include nylon 6, nylon 6/6, nylon 6/9, nylon 6/10, nylon 6T, nylon 6/12, nylon 11, nylon 12, nylon 4,6 and copolymers thereof or mixtures thereof. Polyamides can also be copolymers of nylon 6 or nylon 6/6 and a nylon salt obtained by reacting a dicarboxylic acid component such as terephthalic acid, isophthalic acid, adipic acid or sebacic acid with a diamine such as hexamethylene diamine, methaxylene diamine, or 1,4bisaminomethylcyclohexane. Preferred are poly-, -caprolactam (nylon 6) and polyhexamethylene adipamide (nylon 6/6). Most preferred is nylon 6. The preferred polyamides will exhibit a relative viscosity of between about 2.0 to about 4.5, preferably between about 2.4 to about 4.0.

The distinct domains of the multicomponent fibers according to this invention may also be formed of an amorphous linear polymer which in and of itself is non-fiber-forming. Suitable amorphous polymers for use in the practice of this invention include polystyrene, polyisobutene and poly(methyl methacrylate). When employed in the primary and/or secondary cores, the amorphous polymer is most preferably an amorphous polystyrene, with amorphous atactic polystyrene being particularly preferred.

Another suitable class of polymers that is generally incompatible with polyamides is polyolefin polymers, such as polyethylene, polypropylene and the like. When nylon 6 is employed as one domain of the multicomponent fiber according to this invention, polypropylene is preferred for at least one other domain.

A particularly preferred fiber 10 in accordance with this invention is shown schematically in cross-section in accompanying FIG. 1 and is in the form of a concentric sheath-core bicomponent trilobal fiber structure. As is shown, the fiber 10 includes a trilobal sheath 10-1 which completely surrounds a concentrically positioned core 10-2. A compatibilizing boundary layer region 10-3 comprised of a heterogeneous mixture of the polymers forming the sheath 10-1 and core 10-2 is interposed therebetween. As schematically depicted, the boundary layer region 10-3 includes rivulets or fingers 10-4 and 10-5 of each polymer forming the adjacent sheath and core domains 10-1 and 10-2, respectively, which interlock with one another in a randomly tortuous manner. These different polymer rivulets 10-4, 10-5 thereby effectively increase the surface area at the interfacial boundary between the fiber sheath and core domains 10-1, 10-2 thereby increasing the mechanical interlocking therebetween.

The multicomponent fibers 10 are spun using conventional fiber-forming equipment as shown diagrammatically by the melt-spinning system shown in FIG. 2. Thus, for example, separate melt flows 12, 14 of the polymers having different relative viscosities may be fed by respective extruders 12-1, 14-1 to a conventional multicomponent spinnerette pack 16. The spinnerette pack 16 may be as described in U.S. Pat. Nos. 5,162,074, 5,125,818, 5,344,297, 5,445,884 and 5,533,883 (the entire content of each patent being incorporated expressly hereinto by reference) where the melt flows are passed successively through a number of distinct plates 16-1 through 16-6 so as to form extruded multi-lobal (e.g., tri-, tetra-, penta- or hexalobal) fibers having at least two distinct polymer domains, for example, sheath and core structures. Preferably, the spinnerette 16 is such that fibers having a tri-lobal structure with a modification ratio of at least about 2.0, more preferably between 2.2 and 4.0 may be produced. In this regard, the term "modification ratio" means the ratio $R_1/R_2$, where $R_2$ is the radius of the largest circle that is wholly within a transverse cross-section of the fiber, and $R_1$ is the radius of the circle that circumscribes the transverse cross-section.

The extruded fibers 18 are quenched, for example with air, in a quench cabinet 20 in order to solidify the fibers. The fibers 18 may then be treated with a finish comprising a lubricating oil or mixture of oils and antistatic agents. The thus formed fibers are then combined to form a yarn bundle which is then wound on a suitable package 22. Prior to being wound on the package 22, the yarn may be drawn, for example, between godet rolls 24-1, 24-2 as is well known in the art.

The yarn may also be drawn and texturized in subsequent steps to form a bulked continuous fiber (BCF) yarn suitable for tufting into carpets. A more preferred technique involves combining the extruded or as-spun fibers into a yarn, then drawing, texturizing and winding into a package all in a single step. This one-step method of making BCF is generally known in the art as spin-draw-texturing (SDT).

Nylon fibers for the purpose of carpet manufacturing have linear densities in the range of about 3 to about 75 denier/filament (dpf) (denier=weight in grams of a single fiber with a length of 9000 meters). A more preferred range for carpet fibers is from about 15 to 28 dpf.

The BCF yarns can go through various processing steps well known to those skilled in the art. For example, to produce carpets for floor covering applications, the BCF yarns are generally tufted into a pliable primary backing. Primary backing materials are generally selected from woven jute, woven polypropylene, cellulosic nonwovens, and nonwovens of nylon, polyester and polypropylene. The primary backing is then coated with a suitable latex material such as a conventional styrene-butadiene (SB) latex, vinylidene chloride polymer, or vinyl chloride-vinylidene chloride copolymers. It is common practice to use fillers such as calcium carbonate to reduce latex costs. The final step is to apply a secondary backing, generally a woven jute or woven synthetic such as polypropylene. Preferably, carpets for floor covering applications will include a woven polypropylene primary backing, a conventional SB latex formulation, and either a woven jute or woven polypropylene secondary carpet backing. The SB latex can include calcium carbonate filler and/or one or more the hydrate materials listed above.

While the discussion above has emphasized the fibers of this invention being formed into bulked continuous fibers for purposes of making carpet fibers, the fibers of this invention can be processed to form fibers for a variety of textile applications. In this regard, the fibers can be crimped or otherwise texturized and then chopped to form random lengths of staple fibers having individual fiber lengths varying from about 12 to about 8 inches.

The fibers of this invention can be dyed or colored utilizing conventional fiber-coloring techniques. For example, the fibers of this invention may be subjected to an acid dye bath to achieve desired fiber coloration. Alternatively, the nylon sheath may be colored in the melt prior to fiber-formation (i.e., solution dyed) using conventional pigments for such purpose.

Accompanying FIGS. 2–6 diagrammatically depict exemplary plates that may sequentially be stacked so as to form the spinnerette 16. In this regard, the polymer flows 12, 14 from the extruders 12-1, 14-1 will be directed to a distribution plate 16-1, which in the depicted embodiment is configured so as to form a concentric core-sheath fiber. The polymer flow 12 forming the sheath of the fiber 18 will thus be directed to flow channels 30-1 while the polymer flow 14 forming the core of the fiber 18 will be directed to the flow channel 30-2 as shown in FIG. 3A. The sheath polymer will therefore exit the plate 16-1 through apertures 30-3 while the core polymer will exit the plate 16-1 through aperture 30-4 as shown in FIG. 3B.

Figure 4:
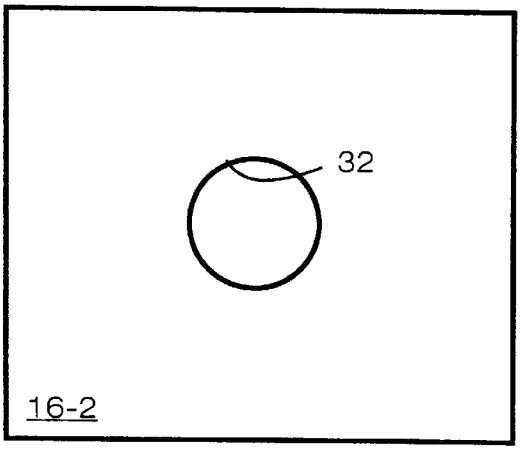
FIG. 4 diagrammatically depicts the top plan view of a spacer plate that may be employed in the spinnerette of the system depicted in FIG. 2.
Figure 10:
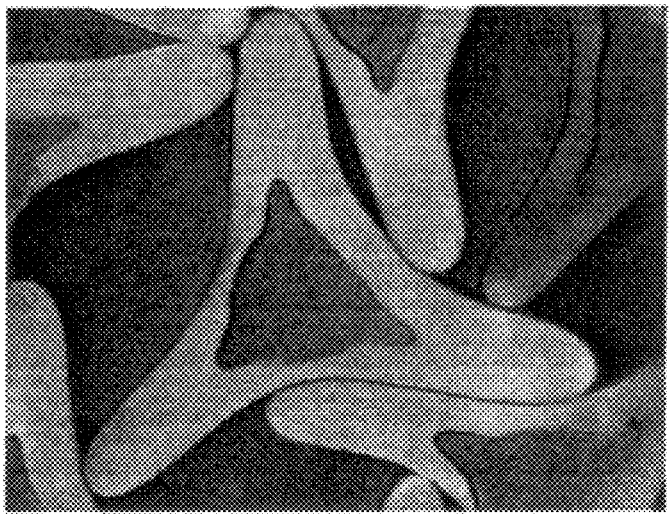
FIGS. 10–15 are photographs of cross sections of fibers made in accordance with the present invention.
Figure 11:
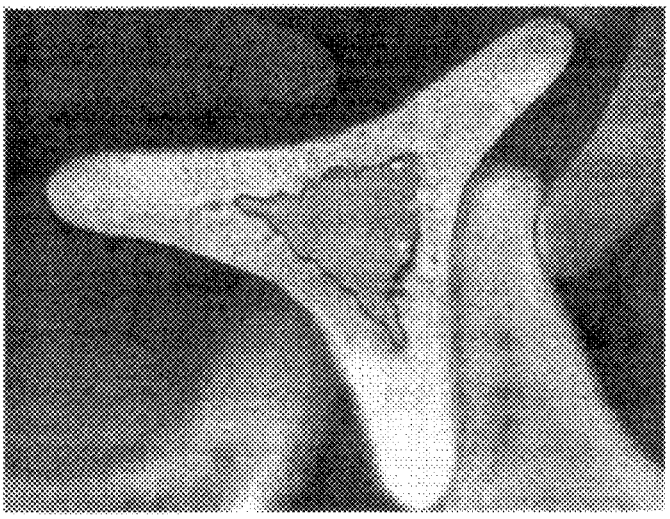
Figure 12:
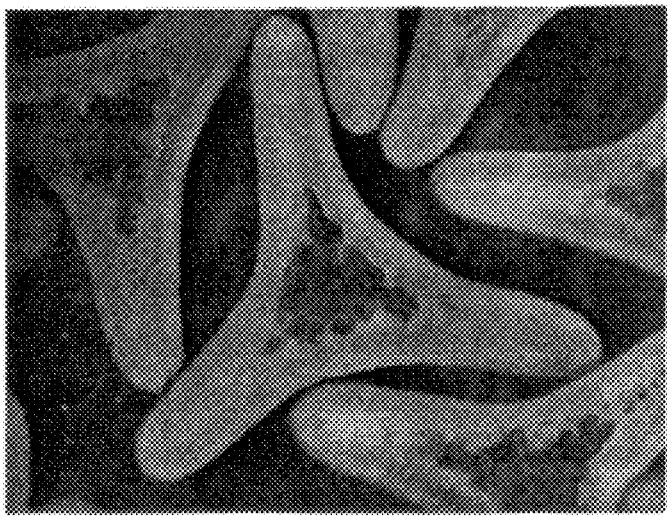
Figure 13:
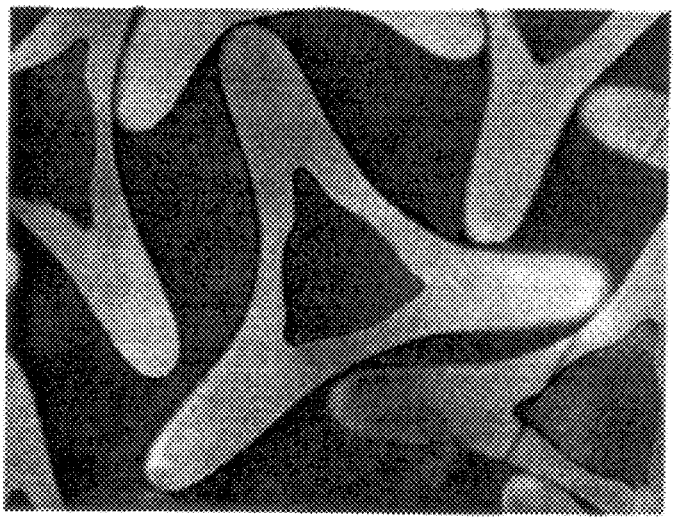
Figure 14:
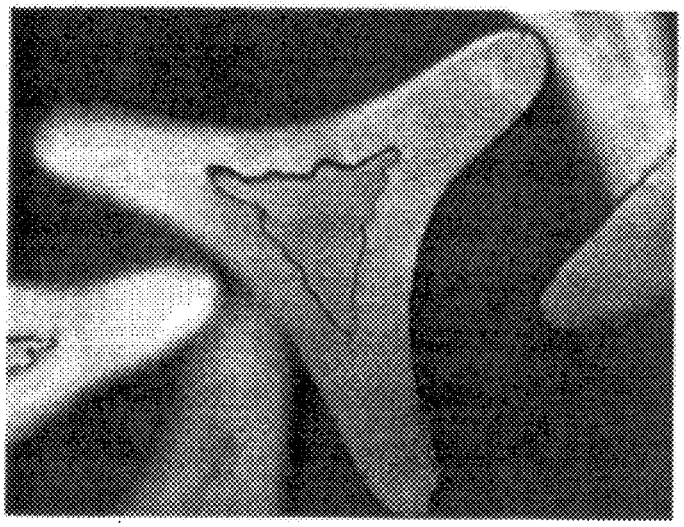
Figure 15:
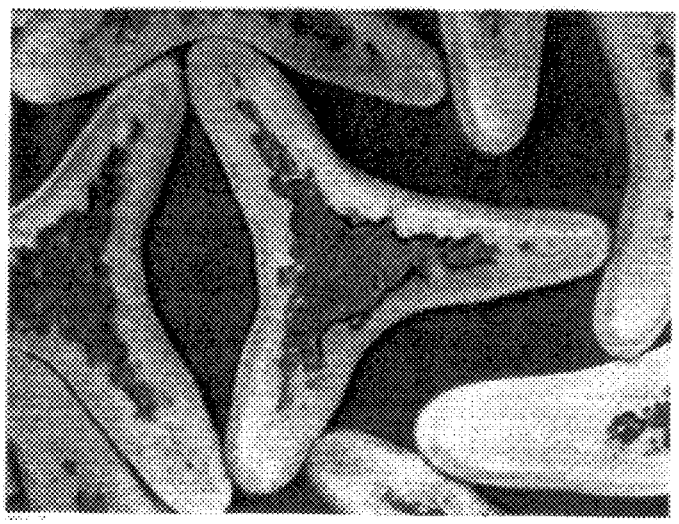

The polymer streams exiting through apertures 30-3 and 30-4 will then proceed through a spacer plate 16-2 as shown in FIG. 4 and then on to an initial compatiblizer plate 16-3 as shown in FIG. 5. In this regard, the spacer plate 16-2 includes a relatively large-diameter circular hole 32 which bounds the apertures 30-3 and 30-4 of plate 16-1 as well as the compatibilizing apertures 34-1 of plate 16-3. The polymer streams exiting the apertures 30-3 and 30-4 will thus form a concentric pool of sheath polymer which completely surrounds the core polymer. This concentric pool of polymer will then be forced through the array of generally circular apertures 34-1. As will be seen from FIG. 7, the rows and columns of apertures 341 are eccentrically oriented relative to the absolute centerline flow path of the polymer streams. As can be appreciated, the polymers at the interfacial boundary of the sheath and core polymers will be caused to shift latitudinally (e.g., in the plane of the plate 16-3) into admixture with one another in order to proceed on through respective ones of the apertures 341.

The polymer flow having an initial mixture at the interfacial boundary between the sheath and core polymers proceeds through another spacer plate 16-4 (see FIG. 2) which is preferably identical to the spacer plate 16-2 shown in FIG. 4 and then on through another compatibilizer plate 16-5 as shown more specifically in accompanying FIG. 6. The compatibilizer plate 16-5 is most preferably identical to the plate 16-3 described previously, but is positioned in the spinnerette 16 so that it is in a reversed order (i.e., so that the aperture array defined by plate 16-5 is a mirror image of that defined by plate 16-3). That is, in practice, the plate 16-5 will be turned upside-down so that the top of the plate 16-3 will be the bottom of plate 16-5 and vice-versa. In such a manner, therefore, the apertures 38-1 of the plate 16-5 will be off-set (misregistered) relative to the apertures 34-1 of the plate 16-3 due to the eccentric positioning of the apertures 34-1 and 38-1 in each of the plates 16-3 and 16-5, respectively, as shown more clearly in FIG. 8.

The partially mixed interfacial region will thus be caused to again shift latitudinally to her enhance the mixing between the sheath and core polymers thereof. Although not shown, any number of additional alternating compatibilizer plates similar to plates 16-3 and 16-5 with interposed spacer plates similar to plate 16-2 may be employed so as to cause further admixing to occur between the sheath and core polymers at their interfacial boundary layer.

The sheath and core polymer flow with the heterogeneous mixture therefore forming the boundary layer is then passed to the backhole 40 of a trilobal spinnerette plate 16-6 as shown in FIG. 9. The resulting melt-spun fiber will thus have the cross-section as schematically depicted in FIG. 1.

It will be understood that, in practice, the plates 16-1 through 16-6 will include multiple sets of apertures and spinnerette orifices so that the spinnerette 16 is capable of spinning multiple individual fibers (e.g., as shown in FIG. 1). In this regard, up to 200 or more fibers may be simultaneously melt-spun employing a corresponding number of sets of apertures and spinnerets as depicted in the accompanying drawing FIGURES.

The invention will be further described by reference to the following detailed examples. The examples are set forth by way of illustration and are not intended to limit the scope of the invention.

EXAMPLES

Nylon 6 (BS700-F from BASF Corporation of Mount Olive, N.J.) as the sheath component and polypropylene (HG3670 Flortilene by Salvoy Polymers) as the core component were combined to form sheath/core trilobal filaments on pilot plant SDT carpet yarn bicomponent equipment. Temperatures in the extruder that supplied the sheath component (Nylon 6) were 240° C., 250° C., 260° C., 263° C., and 267° C. The poly between the extruder and the polymer metering gear pump was heated to 267° C. The temperatures in the extruder that supplied the core component (polypropylene) were 190° C., 200° C., 210° C., and 225° C. The polymer line between the extruder and the polymer metering gear pump was heated to 225° C.

The speed of the polymer metering gear pumps was adjusted such that each filament contained about 25% of the polypropylene polymer as the core and the remaining 75% was the nylon 6 sheath. The sheath and core polymers were directed through two 60 capillary spin packs (of different size) with thin plate arrangements similar to that described in U.S. Pat. No. 5,344,297 to Hills. The spin packs and polymer melt were held at 267° C. The 60 filament yarn from each spin pack subsequently had a lubricating oil applied to it, and was thereafter drawn between two pairs of heated driven rolls with a draw ratio of 2.8, textured using hot air, air entangled, and wound onto a cardboard tube at 2575 meters per minute (mpm). The final resulting fiber had a total target denier of 1115. Therefore, two packages of yarn were produced simultaneously.

The following experiments were carried out to demonstrate the compatibilizing plates. Each experimental condition was split into two different pack designs with a larger pack on the left side of the spin beam and a smaller pack on the right. Other than the size of the pack and spinneret hole spacing, both packs were similar in every respect, and had identical thin plates. FIGS. 10–15 show the resulting fiber cross-sections. Tables I and II below summarize the results of the experiments.

TABLE I

Left Hand Side Large Pack Design

| Example Number | Figure # | Compatibilizer Plates (# sets) | Instron [Energy to Break-WTB in (g-cm)] Average | Standard Deviation | Confidence Level (%) |
|---|---|---|---|---|---|
| 1.0L | 10 | 0 (Control) | 1656 | 195 | — |
| 1.1L | 11 | 2 | 1859 | 158 | 98.9 |
| 1.2L | 12 | 5 | 2177 | 87 | 99.9 |

TABLE II

Right Hand Side Large Pack Design

| Example Number | Figure # | Compatibilizer Plates (# sets) | Instron [Energy to Break-WTB in (g-cm)] Average | Standard Deviation | Confidence Level (%) |
|---|---|---|---|---|---|
| 1.0R | 13 | 0 (Control) | 1867 | 187 | — |
| 1.1R | 14 | 2 | 1932 | 115 | 68.3 |
| 1.2R | 15 | 5 | 2016 | 133 | 96.4 |

The data indicates that the overall strength of the fiber increases with a high degree confidence level when the degree of compatibilization (i.e., the number of sets of compatibilizer plates) is increased. The compatibilization causes the nylon 6 and polypropylene layers to interlock and increases the surface area of adhesion which, in turn, increases the work required to break the fiber.

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of making a multicomponent fiber comprising directing respective melt flows of a first polymer and a second polymer to a spinnerette, forming a multicomponent fiber by extruding the first and second polymers through orifices of the spinnerette to form a fiber having a first domain formed from the first polymer and a second domain formed from the second polymer, said first and second domains being longitudinally coextensive, and simultaneously with said extruding of the first and second polymers, forming a compatibilizing boundary layer between said first domain and said second domain by heterogeneously mixing said first and second polymers at an interface between said first and second domains, wherein said boundary layer comprises rivulets of said first polymer and said second polymer that interlock with one another in a randomly tortuous manner.

2. A method as in claim 1, which further comprises the step of drawing the multicomponent fiber at least 10%.

3. A method as in claim 1, wherein the first domain entirely surrounds the second domain, and wherein the boundary layer entirely surrounds said second domain.

4. A method as in claim 1 or 3, wherein said first domain is formed of a nylon polymer.

5. A method of making a multicomponent fiber comprising directing respective melt flows of a nylon polymer and a polyolefin polymer to a spinnerette, forming a multicomponent fiber by extruding said polymers through orifices of the spinnerette to form a fiber having a first domain formed from the nylon polymer and a second domain formed from the polyolefin polymer, said first and second domains being longitudinally coextensive, and simultaneously with said extruding of the polymers, forming a compatibilizing boundary layer between said first domain and said second domain by heterogeneously mixing said polymers at an interface between said first and second domains.

6. A method as in claim 1, wherein said multicomponent fiber is in the form of a trilobal fiber.

7. A method as in claim 6, wherein said multicomponent fiber includes a nylon sheath domain and a core domain concentrically surrounded by said sheath domain, and wherein said boundary layer is interposed between said core domain and said sheath domain.

8. A method of making a multicomponent fiber comprising directing respective melt flows of a first polymer and a second polymer to a spinnerette, forming a multicomponent fiber by extruding said polymers through orifices of the spinnerette to form a fiber having a first domain formed from the first polymer and a second domain formed from the second polymer, said first and second domains being longitudinally coextensive, and simultaneously with said extruding of the polymers, forming a compatibilizing boundary layer by heterogeneously mixing said polymers at an interface between said first and second domains, wherein said second domain is a polyolefin core and said first domain is a nylon sheath entirely surrounding said core and wherein said boundary layer is interposed between said core and said sheath.

* * * * *